US010526871B2

(12) United States Patent
Tzallas et al.

(10) Patent No.: US 10,526,871 B2
(45) Date of Patent: Jan. 7, 2020

(54) DOWNHOLE CLEANING APPARATUS

(71) Applicant: Odfjell Partners Invest Ltd., Tanager (NO)

(72) Inventors: Nikolaos Tzallas, Dubai (AE); Simon Leiper, Dubai (AE)

(73) Assignee: ODFJELL PARTNERS INVEST LTD., Tananger (NO)

( * ) Notice: Subject to any disclaimer, the term of this patent is extended or adjusted under 35 U.S.C. 154(b) by 47 days.

(21) Appl. No.: 15/128,955

(22) PCT Filed: Mar. 26, 2015

(86) PCT No.: PCT/EP2015/056540
§ 371 (c)(1),
(2) Date: Sep. 23, 2016

(87) PCT Pub. No.: WO2015/150212
PCT Pub. Date: Oct. 8, 2015

(65) Prior Publication Data

US 2017/0074071 A1 Mar. 16, 2017

(30) Foreign Application Priority Data

Mar. 26, 2015 (GB) ..... 1405967.9

(51) Int. Cl.
*E21B 37/04* (2006.01)
*E21B 17/22* (2006.01)
*E21B 23/04* (2006.01)

(52) U.S. Cl.
CPC ..... *E21B 37/045* (2013.01); *E21B 17/22* (2013.01); *E21B 23/04* (2013.01)

(58) Field of Classification Search
CPC ..... E21B 37/04; E21B 37/045; E21B 17/22; E21B 17/10; E21B 34/14; E21B 23/04
See application file for complete search history.

(56) References Cited

U.S. PATENT DOCUMENTS

| | | | |
|---|---|---|---|
| 2,811,210 | A | 10/1957 | Guillot |
| 4,421,182 | A | 12/1983 | Moody et al. |
| 4,452,307 | A | 6/1984 | Horton |
| 5,819,353 | A | 10/1998 | Armell et al. |
| 6,152,221 | A | 11/2000 | Carmichael et al. |
| 6,401,813 | B1 | 6/2002 | Carmichael et al. |
| 2001/0022223 | A1 | 9/2001 | Howlett |
| 2002/0104649 | A1 | 8/2002 | Allen |

(Continued)

FOREIGN PATENT DOCUMENTS

| | | | |
|---|---|---|---|
| CN | 2521386 | Y | 11/2002 |
| GB | 2336612 | A | 10/1999 |

(Continued)

OTHER PUBLICATIONS

Intellectual Property Office, Search Report Under Section 17(5) for GB 1495967.9 (dated Sep. 23, 2014).

(Continued)

*Primary Examiner* — Brad Harcourt
(74) *Attorney, Agent, or Firm* — Wright IP & International Law; Eric G. Wright

(57) ABSTRACT

A downhole cleaning apparatus (10) comprising a tubular body (12). The tubular body (12) comprises comprising a plurality of openings (20) therethrough. Each opening (20) defines at least part of a helix extending longitudinally and circumferentially about the tubular body (12). The downhole cleaning apparatus (10) also includes a plurality of cleaning elements (22). Each cleaning element (22) is configured to extend through an opening (20) and to extend outwards from an outer surface of the tubular body (12). The cleaning elements (22) are distributed about the tubular body (12) and each cleaning element (22) defines at least part of a helix extending longitudinally and circumferentially about the tubular body. The openings (20) and the cleaning elements (22) are grouped to define a plurality of substantially continuous helical paths (18). Each helical path (18) extends substantially end to end of the tubular body and the helical paths (18) are distributed relative to each other to define a cleaning surface of at least 360 degrees.

27 Claims, 6 Drawing Sheets

(56) References Cited

U.S. PATENT DOCUMENTS

| | | | |
|---|---|---|---|
| 2005/0056429 | A1 | 3/2005 | Du et al. |
| 2007/0095573 | A1 | 5/2007 | Telfer |
| 2009/0169319 | A1 | 7/2009 | Hart |
| 2010/0243257 | A1 | 9/2010 | Krieg et al. |
| 2011/0214873 | A1 | 9/2011 | Krieg et al. |
| 2011/0284233 | A1 | 11/2011 | Wu et al. |
| 2013/0192818 | A1 | 8/2013 | Winn et al. |
| 2013/0248249 | A1 | 9/2013 | Xu |
| 2014/0116712 | A1 | 5/2014 | Bansal et al. |
| 2015/0027713 | A1 | 1/2015 | Penisson |
| 2015/0027780 | A1 | 1/2015 | Hern et al. |
| 2015/0114665 | A1 | 4/2015 | Hora et al. |

FOREIGN PATENT DOCUMENTS

| | | | |
|---|---|---|---|
| GB | 2411919 | A | 9/2005 |
| GB | 2411920 | A | 9/2005 |
| WO | 9954590 | A1 | 10/1999 |
| WO | 0107752 | A1 | 2/2001 |
| WO | 0235055 | A1 | 5/2002 |
| WO | 03087526 | A1 | 10/2003 |
| WO | 2004022907 | A1 | 3/2004 |
| WO | 2004067908 | A1 | 8/2004 |
| WO | 2004088091 | A1 | 10/2004 |
| WO | 2006016102 | A2 | 2/2006 |
| WO | 2007003894 | A2 | 1/2007 |
| WO | 2010015861 | A2 | 2/2010 |
| WO | 2010048167 | A2 | 4/2010 |

OTHER PUBLICATIONS

European Patent Office, International Search Report for PCT/EP2015/056540 (dated Mar. 3, 2016).

European Search Report for GB1509015.2, Intellectual Property Office (dated Sep. 8, 2015).

Patents Act 1977: Search Report Under Section 17(5), GB1405967.9, IPO (dated Sep. 23, 2014).

DOWNHOLE CLEANING APPARATUS

FIELD OF INVENTION

The present invention relates to well cleaning. In particular, the present invention relates to cleaning apparatus operable to clean a well casing to remove unwanted material and debris from the interior surface of a well casing.

INCORPORATION BY REFERENCE

This patent application incorporates by reference in its entirety patent application GB 1405967.9 filed Apr. 2, 2014, entitled "Downhole Cleaning Apparatus" to which foreign priority is claimed.

CROSS-REFERENCE TO RELATED APPLICATIONS

This application is a US National Stage Application of PCT/EP2015/056540 filed Mar. 26, 2015, entitled "Downhole Cleaning Apparatus" and claims foreign priority to GB 1405967.9 filed Apr. 2, 2014, which is entitled "Downhole Cleaning Apparatus".

BACKGROUND TO THE INVENTION

Typically the method of removal of debris from oil and gas wells includes scrapers or brushes, which mechanically clean the interior casing of the well. Such scrapers or brushes are typically run as part of a dedicated wellbore cleanup system, which is implemented after a well has been drilled, cased and cemented.

More recent developments have seen the introduction of casing scrapers that are run as part of the drilling string. Such scrapers generally include retracted blades, for run in, and extended blades, which are activated such that the blades make contact with the casing wall when the cleaning action is required.

Typically, known casing scrapers comprise axial slots and blades that extend from the axial slots to make contact with the casing surface.

Scrapers comprising axial slots and blades extending therefrom are typically operated by combined slow axial movement and high speed rotational motion such that the blades are reamed to ensure contact with the entire 360 degree surface of the casing wall to be effective in dislodging debris from the entire 360 degree surface of the casing wall. Using this method to clean casing is time consuming and as a result the time and cost of cleaning the entire wellbore prohibits the requirement to do so.

It is desirable to provide an improved downhole cleaning apparatus.

SUMMARY OF INVENTION

According to a first aspect of the present invention there is provided a downhole cleaning apparatus comprising: a tubular body comprising a plurality of openings therethrough, wherein each opening defines at least part of a helix extending longitudinally and circumferentially about the body; and a plurality of cleaning elements configured to extend through the openings and to extend outwards from an outer surface of the body, wherein the cleaning elements are distributed about the body and each cleaning element defines at least part of a helix extending longitudinally and circumferentially about the body, wherein the openings and cleaning elements are grouped to define a plurality of substantially continuous helical paths, each of which extend substantially end to end of the tubular body and are distributed to define a cleaning surface of at least 360 degrees.

The helical paths may be arranged such that the circumferential extent of the combined helical paths is at least 360 degrees. For example, in an embodiment comprising three helical paths each path extends circumferentially by at least 120 degrees. The arrangement of the helical paths, as defined by the openings and cleaning elements, may define an active cleaning surface of at least 360 degrees.

The downhole cleaning apparatus may comprise a plurality of flutes, each flute being defined by at least part of a helix extending longitudinally and circumferentially about the body, wherein between each flute a rib is defined. The ribs define the outermost surface of the cleaning apparatus. The flutes and ribs may be defined by the helical path.

The openings may be provided on the ribs.

The downhole apparatus may comprise at least three ribs defined by three flutes.

Advantageously, the arrangement of the cleaning elements on a cleaning apparatus, according to the first aspect, means that cleaning of casing wall can be performed efficiently by means of reciprocating motion only, or by means of a combination of high speed reciprocation and rotation. Known devices use rotational motion combined with slow axial motion to clean the casing wall. Typically, a scraper is reciprocated three times over a given area to be cleaned. A typical scraper comprises three blades, each blade measuring 228 mm (9 inches) long with a rotational speed of around 60 revolutions per minute. The reciprocating velocity is typically a maximum of 0.23 m/s (45 ft/min). In contrast, a cleaning apparatus according to present invention can be reciprocated up to 0.76 m/s (150 ft/min). It will be appreciated that the arrangement of the cutting elements and the relatively high speed application of the device according to the present invention leads to a reduction in cleaning time and the same or more efficient cleaning of a comparative casing wall compared with the known devices.

The openings may be provided by a plurality of slots, wherein at least a corresponding number of cleaning elements are provided wherein one or more cleaning elements extend through each slot.

The cleaning elements may be retractable and extendable, wherein when retracted the cleaning elements are storeable within the body until required for use and when required for use the cleaning elements are extendable wherein they extend outwards from the outermost surface of the body.

The cleaning elements may be selectively extended. As such, the downhole cleaning apparatus may further comprise a holding system and an activation system, whereby the cleaning elements are held in a retracted position by the holding system until required for use and the activation system is operable to at least prime the cleaning elements for movement from a retracted position to an extended position.

The holding system may comprise one or more shear pins. The shear pins may require a minimum pressure or load to be applied in order for the shear pin to break or shear. The holding system may include a plurality of shear pins arranged such that each shear pin is breakable or shearable at a different minimum force or pressure, such that upon activation the plurality of shear pins are broken sequentially from the pin rated by lowest minimum force or pressure to the pin rated by highest minimum force or pressure.

In use, the activation system may comprise one or more stages of activation, wherein one or more of the following may be applied: a mechanical trigger, an electronic signal and an applied fluid pressure. Where a plurality of activation stages is utilised each stage may be activated sequentially such that a change of position from retracted to extended is controllable in a predictable manner.

The activation system may comprise one or more of the following: a ball and a dart.

The ball or dart may, when released into the tubular body, come to rest in a seat to increase internal pressure within the tubular body, which increase in pressure being operable to break or shear at least one shear pin such that the cleaning elements are at least partially primed for movement from a retracted position to an extended position. The ball or dart may be released by a mechanical trigger, electronic signal or applied fluid pressure.

The ball may be made from a deformable material.

The seat may be configured to allow the ball or dart to pass through. The seat may be deformable under pressure. The seat may comprise a collet. The collet may comprise expanding jaws or dogs, which are displaceable thereby allowing the dart or ball to pass through.

Alternatively, or in addition, the activation system may further comprise a setting sleeve, internal to the tubular body, and operable to move in an axial direction relative to the tubular body and operable to break or shear at least one or more shear pins such that the cleaning elements are at least partially primed for movement from retracted to extended. The tubing body and the setting sleeve may each comprise an angular profile such that movement of the sleeve relative to the tubing body is guided. The setting sleeve may be activated by a mechanical trigger, electronic signal or applied fluid pressure.

Alternatively, or in addition, the activation system may comprise further movement of the setting sleeve or the activation ball such that fluid pressure within the tubular body can increase to a level operable to break or shear a shear pin to finally prime the cleaning elements for movement from retracted to extended. The further movement of the setting sleeve or ball may be activated by a mechanical trigger, electronic signal or applied fluid pressure.

A mechanical trigger, electronic signal or fluid pressure may move the cleaning elements from retracted to extended.

Each cleaning element may be biased to an extended position, wherein the one or shear pins prevent, until broken or sheared, movement of the cleaning element from a retracted position to an extended position. The downhole cleaning apparatus may further comprise a mechanical or hydraulic spring arranged to assist movement from a retracted position and to maintain position of the cleaning members in the extended position.

Each cleaning element comprises a cutting profile operable, in use, by axial reciprocation to remove debris from a surface in which the cleaning elements are in contact. The arrangement of the cleaning elements to define a cutting surface of at least 360 degrees and a suitable cutting profile ensures that a full circumferential clean, for example of a wellbore casing, is achievable by a downhole cleaning apparatus according to the first aspect.

The cleaning element may be a scraper blade. Alternatively, the cleaning element may be a brush.

The downhole apparatus may be connectable to a drilling tool or drill string. The downhole cleaning apparatus may be connectable above a drill bit of a drilling tool in a downhole application. The downhole cleaning apparatus may further comprise male or female connections arranged to connect each end of the tubular body to a drilling element.

A further aspect of the present invention provides a method of cleaning a wellbore casing, the method comprising the step of installing a downhole cleaning apparatus according to the first aspect into the wellbore casing. The method may further comprise, prior to installing the downhole apparatus in into the wellbore casing, the step of attaching the downhole cleaning apparatus to a drill string and thereby installing the downhole cleaning apparatus together with the drill string.

The method may further comprise priming the downhole cleaning apparatus such that the cleaning elements are ready for moving from retracted to extended, wherein the cleaning elements extend from an outermost surface of the tubular body.

The method may further comprise the step of moving the cleaning elements from retracted to extended.

The method may further comprise the step of reciprocating the downhole cleaning apparatus in an axial direction, thereby performing the step of cleaning the wellbore casing.

The method may further comprise withdrawing the downhole cleaning apparatus from the wellbore casing.

BRIEF DESCRIPTION OF THE DRAWINGS

Embodiments of the present invention are described below, by way of example only, with reference to the accompanying drawings, in which.

BRIEF DESCRIPTION

Figure 1:
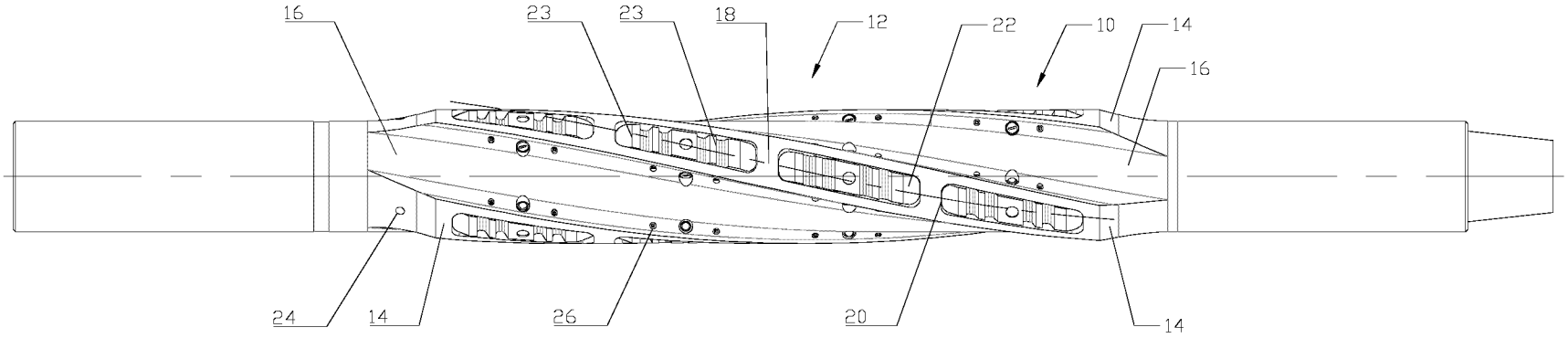
FIG. 1 is a schematic representation of a downhole cleaning apparatus according to an embodiment of the present invention in a retracted position.
Figure 2:
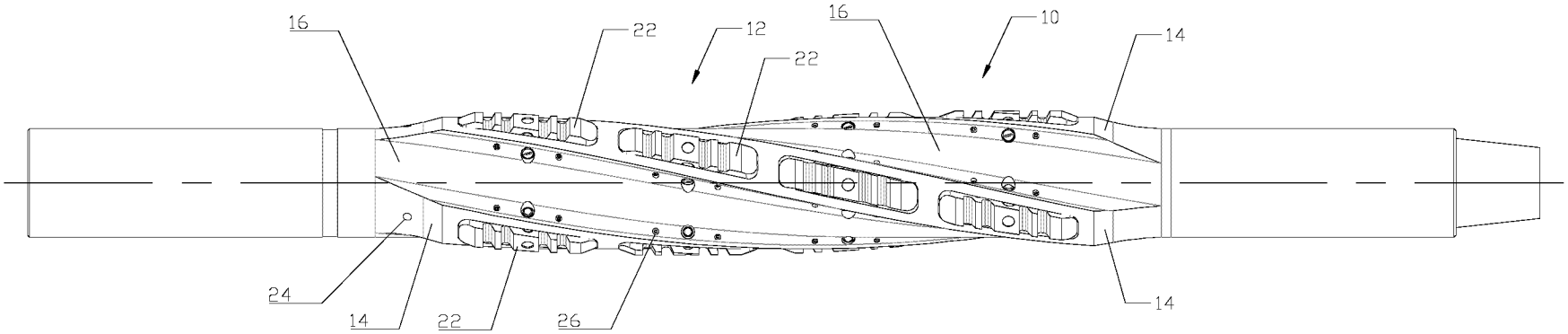
FIG. 2 is a schematic representation of a downhole cleaning apparatus according to an embodiment of the present invention in an extended position.

FIGS. 1 and 2, each show a casing cleaner 10, which represents a downhole cleaning apparatus according to an embodiment of the present invention. The casing cleaner 10 includes a tubular body 12, which comprises an axial through bore (not visible in FIG. 1 or 2). The casing cleaner 10, in the illustrated embodiment, includes three external ribs 14. Flutes 16 (two visible in FIGS. 1 and 2) separate the ribs 14 and define zones via which debris dislodged from the casing wall (not illustrated) can be discharged.

The ribs 14 and flutes 16 of the illustrated embodiment each define part of a helix 18 which extends end to end on the external surface of the body 12.

Each rib 14 includes slots 20 through which cleaning elements 22 extend. The slots 20 and cleaning elements 22 each define part of the helix 18 defined by the ribs 14 and flutes 16. In the illustrated embodiment each of the helical ribs 14 includes four slots 20 and four cleaning elements 22.

In respect of the casing cleaner 10, as illustrated, the circumferential extent of each helix 18 is at least 120 degrees such that, in use, the cleaning elements 22 are operable to be in contact with the entire 360 degree casing surface. The arrangement of the ribs 14 and cleaning elements 22 in the form of a helix means that, in use, the casing cleaner 10 needs only to be operated in a reciprocating manner.

The cleaning elements 22 in the illustrated embodiment are scraper blades. Scraper blades comprise a plurality of cutting edges 23 that act against the casing wall to dislodge debris as the cleaner passes through the casing. Casing scrapers may be constructed from, for example, machined low alloy steel. Alternatively, the blades may be constructed from forgings. The material choice and construction of the blades is that which demonstrates long lasting durability and excellent scraping characteristics. Alternatively, the cleaning elements may be brushes, which can be used to brush and clean the interior surface/circumference of a casing to remove scale, rust, mud residue and other types of debris. The scraper blades and brushes are configured to act in an abrasive manner to clean the casing wall.

The cleaning elements 22 are arranged to be retracted, when run in, see FIG. 1 and extended, when in use, see FIG. 2. Shear pins 24, 26 are located through holes in the tubular body 12 to retain the cleaning elements 22 in a retracted position until a predetermined fluid pressure is applied via the axial bore 34 (see FIGS. 3 and 4). In the illustrated example, fluid pressure is used to activate a mechanism operable to break or shear the pins 26, 28 such that the cleaning elements 22 are at least partially primed for extension.

Figure 3:
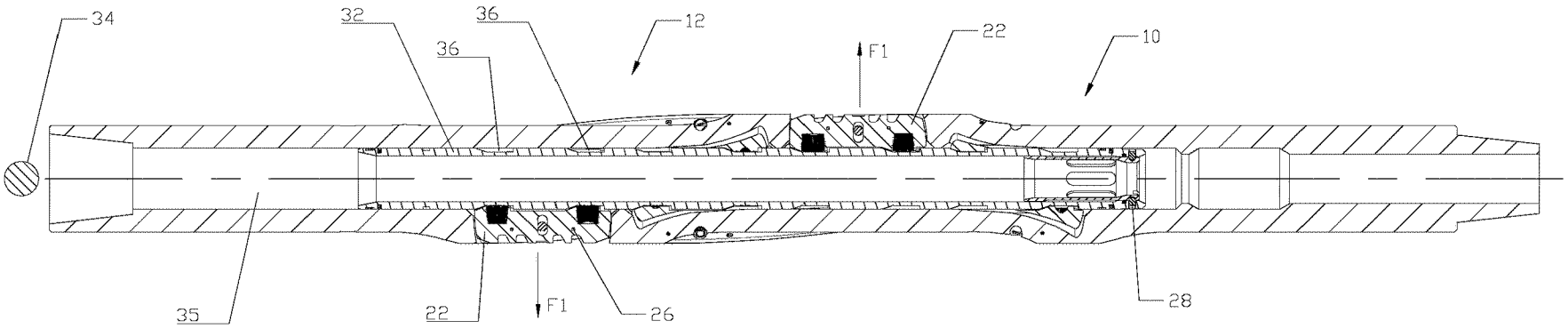
FIG. 3 is a schematic representation of an axial cross-section of the downhole cleaning apparatus as illustrated in FIG. 1.
Figure 4:
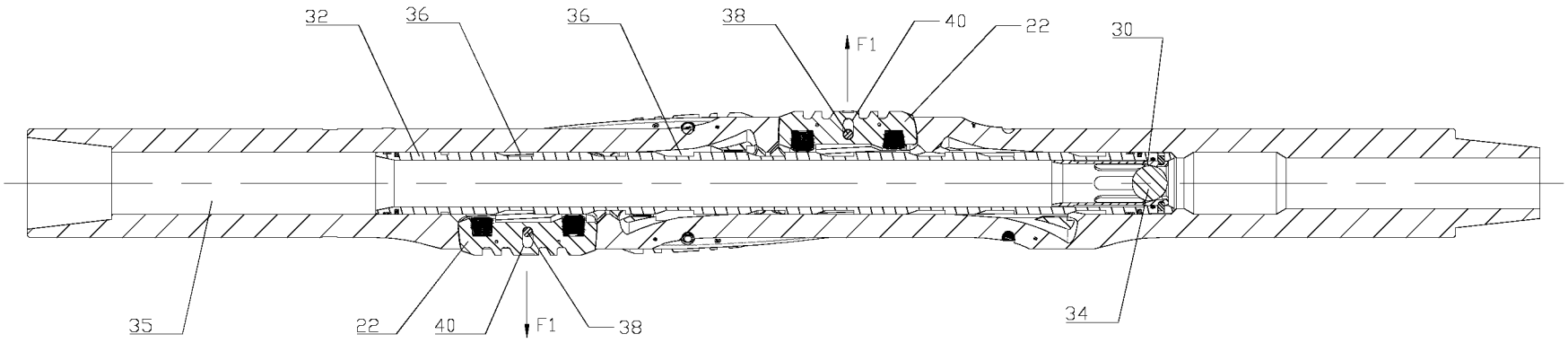
FIG. 4 is a schematic representation of an axial cross section of the downhole cleaning apparatus as illustrated in FIG. 2 wherein the cleaning elements are in an extended position.

FIGS. 3 and 4 each illustrate a cross-sectional view of the casing cleaner 10 as illustrated in FIGS. 1 and 2 respectively. It will be appreciated that FIGS. 3 and 4 provide a clearer representation of how the cleaning elements 22 are held in the retracted position (as illustrated in FIGS. 1 and 3) and how the cleaning elements 22 move to the extended position (as illustrated in FIGS. 2 and 4).

FIGS. 3 and 4 represent the activation stages required to release the cleaning elements 22 from the retracted position to the extended position. FIG. 3 represents the retracted position where the cleaning elements 22 are held within the tubular body 12 and therefore cannot contact the casing wall. In the illustrated embodiment the cleaning elements 22 are biased by spring force F1 to the extended position, but are held in a retracted position by a series of shear pins 24, 26, 28. Shear pin 24 acts to restrain a setting sleeve 32 from moving within the axial bore 35. Shear pin 26 acts to restrain the cleaning elements 22 in the retracted position and shear pin 28 acts to restrain a ball seat 30.

The setting sleeve 32 is positioned within the axial bore 35. The setting sleeve 32 is held against movement relative to the tubular body 12 by shear pin 24. The shear pin 24 engages with the tubular body 12 and the setting sleeve 32. The setting sleeve 32 includes an external profile with tapered sections 36 which engage with similar profiles on the inside surface of the cleaning elements 22, such that when the setting sleeve 32 is released it moves axially, as guided by the bore 35, to move the cleaning elements 22 to the extended position.

The shear pins 24, 26, 28 are sheared or broken as a result of fluid pressure being applied within the axial bore 35. A predetermined fluid pressure or force is required to shear the pins 24, 26, 28 such that the sleeve 32 is released to act upon the cleaning elements 22. Each shear pin 24, 26, 28 responds to a different predetermined pressure, where the shear pins 24 shear or break upon application of pressure lower than the pressure required by shear pin 26 and shear pin 26 will shear or break upon application of pressure lower than the pressure required by shear pin 28.

To activate the cleaning elements 22 to the extended position the axial bore 35 is sealed by release of a ball 34 (see FIGS. 3 and 4). As illustrated in FIG. 3, the ball 34 is dropped into the axial bore 35 from surface and is either pumped down or allowed to drop freely. The ball 34 comes to rest on the ball seat 30 such that fluid pressure within the axial bore 35 can increase to the predetermined level in which pins 24 shear or break to release the setting sleeve 32 which will begin to move downwards (to the right in the illustrated embodiment).

As the setting sleeve 32 moves downwards, towards the drill bit 51 (see FIG. 6) the tapered sections 36 acts upon the similarly shaped profile of the cleaning elements 22 thereby priming the cleaning elements 22 for movement to the extended position. A substantially radial load is generated by the physical contact of the setting sleeve 32 upon the cleaning element 22 and acts to shear the shear pins 26 to release the cleaning elements 22. By shearing the shear pin 26 the cleaning elements 22 are primed for extension under the spring force F1, which biases the cleaning elements 22 to the extended position.

The cleaning elements 22 are restrained from being fully expelled from the tubular body 12 by engagement with the casing wall and locking pins 38 as shown in the illustrated embodiment. The locking pins 38 are arranged to slide within a slot 40 provided in the body of the cleaning element 22 such that the range of movement of the cleaning element 22 is controlled.

Figure 5:
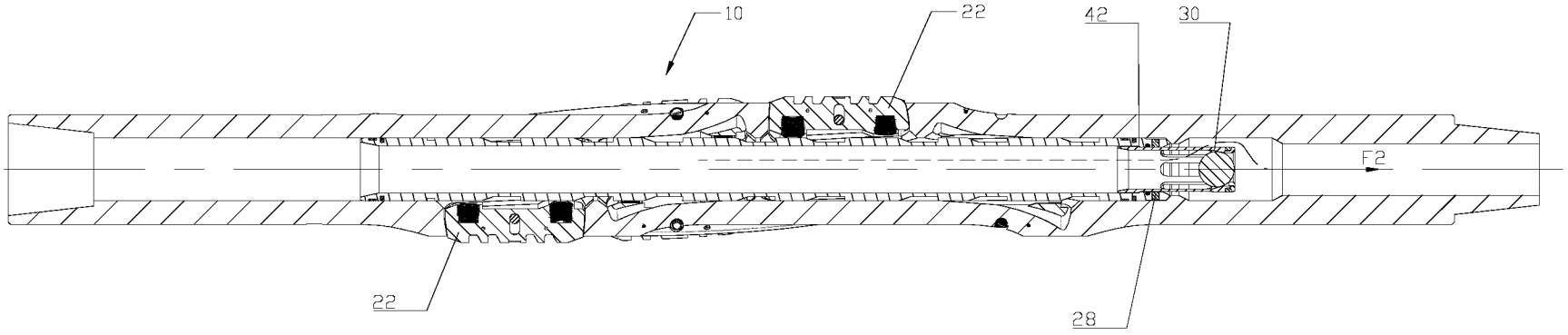
FIG. 5 is a schematic representation of an axial cross section of the downhole cleaning apparatus as illustrated in FIG. 2.

At this stage the cleaning elements 22 are extended and ready to clean the casing. To begin the cleaning process fluid flow through the casing cleaner 10 needs to be restored. Referring to FIG. 5, by raising fluid pressure within the axial bore 34 to a predetermined level the shear pins 28, which are located at the ball seat 30 are sheared and a ball seat sleeve 42 is released and moved downwards by a distance sufficient to allow fluid flow F2 through the axial bore 35 and to the drill bit 51 beneath (see FIG. 6). Once fluid flow through the device 10 is restored the cleaning elements 22 are in the ready position, where they are extended and ready for application to clean the casing in which they are deployed.

Cleaning the casing with a casing cleaner 10 according to the embodiments described above may be by axial reciprocating motion only where the casing cleaner 10 need only be moved upwards (to the left in the illustrated embodiment) and downwards (to the right in the illustrated embodiment) to remove debris from the inner casing wall. Any debris is expelled via the flutes.

The configuration of the casing cleaner 10 according to embodiments of the present invention is such that high speed reciprocation combined with rotation of the casing cleaner 10 is effective in removing debris from the casing wall quickly and efficiently.

Figure 6:
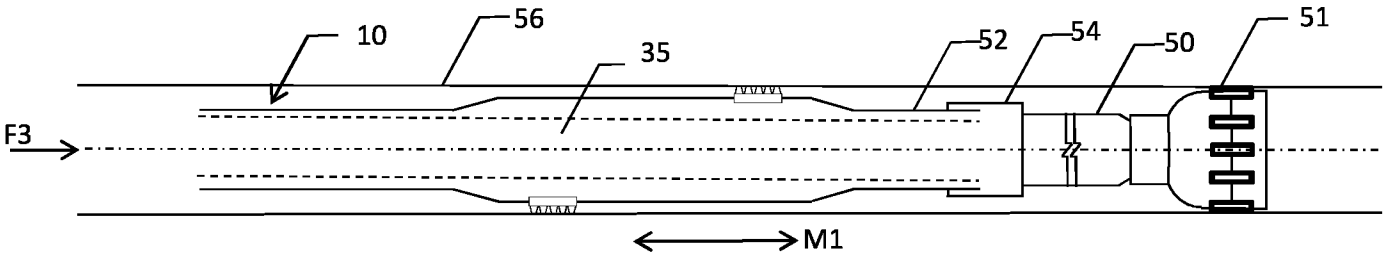
FIG. 6 is a schematic representation of an assembly of a casing cleaner as illustrated in FIGS. 1 to 5 and a drill string.

A method of application of the casing cleaner 10 according to described embodiments is illustrated in FIG. 6, where the casing cleaner 10 is attached to a drill string 50 by suitable male or female mechanical connections 52, 54. The connections 52, 54 are suitable for attachment to a drill string 50.

The arrangement illustrated in FIG. 6 demonstrates an integrated formation and cleaning process.

The casing cleaner 10 is attached to the upper side of the drill string 50 comprising a drill bit 51. The assembly of drill string 50 and casing cleaner 10 is then run into the casing 56 in a known manner. The cleaning elements 10 are retracted into the tubular body for run-in and extended for cleaning.

The drill string 50 is used in a known manner to drill a hole, for example a new wellbore. This may involve drilling, using a suitable drill bit 51, through the base of an existing casing 56 in which the drill string 50 is run-in and creating a new bore in the direction of a drilling target zone.

When the drilling step is complete the cleaning operation can be initiated wherein an activating device, such as a ball (described above) or a dart is released to block fluid flow through the centre of the assembly. Fluid F3 is pumped into the axial bore 35 of the casing cleaner 10 such that the activation process described above takes place to move the cleaning elements 22 from a retracted position to an extended position. The method includes resuming fluid flow through the device by releasing the sleeve 42 that provides support for the ball 34 or dart (not illustrated) and allowing fluid flow F2 through the device (see FIG. 5). When fluid flow F2 is resumed through the device the assembly is moved upwards and downwards (reciprocating motion) in the direction M1 (as illustrated in FIG. 6) such that the cleaning elements 22 actively clean debris from the casing wall 56.

Pressure monitoring of fluid within the device may be used to determine when the casing cleaner 22 is fully extended and ready for use.

Each stage of the activation process, as described above requires a predetermined, but different pressure to shear each shear pin 24, 26, 28. As such the activation of the cleaning elements 22 to an extended position is fully controllable. By monitoring the pressures within the axial bore 35 of the casing cleaner 10 it can be determined with certainty that the cleaning elements 22 are in the extended position and the cleaning process can be carried out with certainty also.

When cleaning is complete the method also includes retrieval of the casing cleaner 10 at surface as the drill string 50 is removed from the casing 56.

Whilst specific embodiments of the present invention have been described above, it will be appreciated that departures from the described embodiments may still fall within the scope of the present invention.

The invention claimed is:

1. A downhole cleaning apparatus comprising:

a tubular body having a radial thickness extending from an inner diameter to an outer diameter comprising a plurality of openings, wherein each opening of said plurality of openings extends through said radial thickness from said inner diameter to said outer diameter;

wherein each opening of said plurality of openings defines at least part of a helix extending longitudinally and circumferentially about the body; and a plurality of cleaning elements having a retracted state and an extended state;

each of said plurality of cleaning elements maintained in said retracted state by an interlocking retaining member;

said interlocking retaining member reversibly interlocking said each of said plurality of cleaning elements with an adjacent portion of the downhole cleaning apparatus maintaining said each of said plurality of cleaning elements in said retracted state;

said interlocking retaining member released to free said each of said plurality of cleaning elements to move radially outward to achieve said extended state;

said radially outward movement to achieve said extended state extends each of said plurality of cleaning elements through the openings and to extend outwards from an outer surface of the body, wherein the cleaning elements are distributed about the body and each cleaning element defines at least part of a helix extending longitudinally and circumferentially about the body, wherein the openings and cleaning elements are grouped to define a plurality of substantially continuous helical paths, each of which extend substantially end to end of the tubular body and are distributed to clean a surface having a circumference of 360 degrees.

2. A downhole cleaning apparatus as claimed in claim 1, wherein the helical paths are arranged such that the combined circumferential extent of the helical paths as measured about the circumference of the cleaning apparatus is at least 360 degrees.

3. A downhole cleaning apparatus according to claim 1 wherein the arrangement of the helical paths, as defined by the openings and helically positioned cleaning elements and defines an active cleaning surface of the cleaning elements of at least 360 degrees as measured about the circumference of the cleaning apparatus.

4. A downhole cleaning apparatus according to claim 1, further comprising a plurality of flutes, each flute being defined by at least part of a helix extending longitudinally and circumferentially about the body, wherein a rib is defined between each flute.

5. A downhole apparatus as claimed in claim 4, wherein the ribs define the outermost surface of the cleaning apparatus and wherein the flutes and ribs are each defined by the helical path.

6. A downhole cleaning apparatus as claimed in claim 5, wherein the openings are provided through the ribs.

7. A downhole cleaning apparatus according to claim 1, wherein the openings are provided by a plurality of slots and wherein at least a corresponding number of cleaning elements are provided wherein one or more cleaning elements extend through each slot.

8. A downhole cleaning apparatus according to claim 1, wherein the cleaning elements are retractable and extendable, wherein when retracted the cleaning elements are storeable within the body until required for use and, when required for use and in use, the cleaning elements are extendable wherein they extend outwards from the outermost surface of the body.

9. A downhole cleaning apparatus as claimed in claim 8, further comprising a an activation system, and wherein each respective cleaning element is held in a retracted position by the interlocking retaining member until required for use, and wherein the activation system is operable to at least prime the cleaning elements for movement from a retracted position to an extended position.

10. A downhole cleaning apparatus according to claim 9, wherein the activation system comprises a setting sleeve, internal to the tubular body, and operable to move in an axial direction relative to the tubular body and operable to break or shear at least one or more shear pins such that the cleaning elements are at least partially primed for movement from retracted to extended.

11. A downhole cleaning apparatus as claimed in claim 10, wherein the setting sleeve and the cleaning elements each comprise an angular profile such that movement of the sleeve relative to the cleaning element is effective in moving the cleaning elements from retracted to extended.

12. A downhole cleaning apparatus as claimed in claim 1, wherein the interlocking retaining member is a shear pin.

13. A downhole cleaning apparatus according to claim 12, wherein the activation system comprises at least one of a ball and a dart.

14. A downhole cleaning apparatus according to claim 13, wherein a seat is configured to allow the ball or the dart to pass through after the cleaning elements assume an extended position.

15. A downhole cleaning apparatus as claimed in claim 14, wherein the seat is connected to a moveable sleeve, wherein the moveable sleeve is movable under application of a predetermined fluid pressure.

16. A downhole cleaning apparatus according to claim 12, wherein each cleaning element is biased to an extended position and wherein one or more of said shear pins prevent, until broken or sheared, movement of the cleaning element from retracted to extended.

17. A downhole cleaning apparatus according to claim 1, wherein each cleaning element comprises a cutting profile operable, in use, by axial reciprocation to remove debris from a surface in which the cleaning elements are in contact.

18. A downhole cleaning apparatus as claimed in claim 17, wherein the cleaning elements are arranged to define a cutting surface of 360 degrees.

19. A downhole cleaning apparatus according to claim 1, wherein the cleaning element is a scraper blade.

20. A downhole cleaning apparatus according to claim 1, wherein the cleaning element is a brush.

21. A downhole cleaning apparatus according to claim 1, wherein the interlocking retaining member holds each of said plurality of cleaning elements in a fixed radial position when said plurality of cleaning elements are maintained in said retracted state.

22. A downhole cleaning apparatus according to claim 1, wherein the interlocking retaining member extends from a respective portion of each of said plurality of cleaning elements interlocking with a different portion of said cleaning apparatus to maintain said plurality of cleaning elements in said retracted state.

23. A downhole cleaning apparatus according to claim 1, wherein a respective interlocking retaining member is released from fixing the radial position of the cleaning element when said cleaning element is transitioned from said retracted state to said extended state.

24. A downhole cleaning apparatus according to claim 1, further comprising:

a guide slot configured in a portion of said each of said plurality of cleaning elements, wherein said guide slot guides the motion of said each of said plurality of cleaning elements when transitioning from said retracted state to said extended state.

25. A downhole cleaning apparatus according to claim 1, further comprising:

a guide slot configured in a portion of said each of said plurality of cleaning elements, wherein said guide slot limits the motion of said each of said plurality of cleaning elements when transitioning from said retracted state to said extended state.

26. A downhole cleaning apparatus according to claim 1, further comprising:

a locking pin configured to engage a portion of said each of said plurality of cleaning elements, wherein said locking pin limits the motion of said each of said plurality of cleaning elements when transitioning from said retracted state to said extended state.

27. A downhole cleaning apparatus according to claim 1, further comprising:

a guide slot configured in a portion of said each of said plurality of cleaning elements and configured to receive a locking pin; and a locking pin configured to engage a portion of said guide slot.

* * * * *